US005326010A

United States Patent [19]

Moras

[11] Patent Number: 5,326,010

[45] Date of Patent: Jul. 5, 1994

[54] TRACTION UNIT FOR A DRAWING MACHINE

[75] Inventor: Paolo Moras, Udine, Italy

[73] Assignee: Danieli & C. Officine Meccaniche SpA, Buttrio, Italy

[21] Appl. No.: 993,705

[22] Filed: Dec. 21, 1992

[30] Foreign Application Priority Data

Dec. 24, 1991 [IT] Italy ..... UD91 A 000217

[51] Int. Cl.[5] ..... B65H 20/00

[52] U.S. Cl. ..... 226/172; 226/170

[58] Field of Search ..... 226/170, 171, 172, 173

[56] References Cited

U.S. PATENT DOCUMENTS

| | | | |
|---|---|---|---|
| 2,212,132 | 8/1940 | Shear | 226/172 X |
| 2,742,144 | 4/1956 | Meyerbach | 226/172 X |
| 3,103,306 | 9/1963 | Eldik | 226/172 |
| 3,143,269 | 8/1964 | Van Eldik | 226/172 |
| 3,580,451 | 5/1971 | Fraitzl | 226/173 |
| 3,684,145 | 8/1972 | Jenkins | 226/173 |
| 3,690,534 | 9/1972 | Biron | 226/172 X |
| 3,915,291 | 10/1975 | Vogts | 226/172 X |
| 3,945,547 | 3/1976 | Ledebur | 226/172 |
| 4,034,904 | 7/1977 | Juditzki | 226/172 X |
| 5,238,165 | 8/1993 | Groblacher et al. | 226/172 |

FOREIGN PATENT DOCUMENTS 58-154412 9/1983 Japan .

*Primary Examiner*—Daniel P. Stodola
*Assistant Examiner*—Paul Bowen
*Attorney, Agent, or Firm*—Antonelli, Terry, Stout & Kraus

[57] ABSTRACT

Traction unit for a drawing machine, the unit cooperating with a drawing die (14) and comprising at least two drive chains (12) with drawing links lying on the same plane and consisting of a plurality of links (16), the drive chains (12) with drawing links cooperating with load bearing rollers and with a rigid guide (19), the drawing action being obtained by the forward movement of the drive chains (12) with drawing links and by the reciprocal contact taking place between the drawing chains (12) with drawing links in their opposed drawing segment (15), the load bearing rollers being associated with a linked chain (26) of idler rollers (17) and being idler rollers (17) positioned in a ring, the linked chain (26) of idler rollers (17) being able to be moved by sliding and being placed between the inner surface of the links (16) and the rigid guide (19).

8 Claims, 2 Drawing Sheets

TRACTION UNIT FOR A DRAWING MACHINE

BACKGROUND OF THE INVENTION

This invention concerns a traction unit for a drawing machine.

To be more exact, the invention concerns a traction unit of a drawing machine, the traction unit being positioned downstream of the drawing die and having the purpose of drawing the metallic stock in a continuous, regular manner with a required drawing action so that the metallic stock is drawn.

The invention is applied advantageously to the field of the drawing of metals.

Devices to draw metals, as is known, comprise substantially an element or drawing die to reduce the section of the stock and means to draw lengthwise the metallic stock to be subjected to the drawing process. These drawing means can apply their action to the stock in a discontinuous or a continuous manner.

Discontinuous drawing means generally include gripper means with one or more grippers, which clamp the stock and draw it, but these means entail the problem that the section of the stock is deformed at the gripping points and the stock is marked when the gripper is changed. In fact, these gripper drawing means develop speeds which are no longer adequate.

Continuous drawing means generally comprise a device consisting of two opposed chains, which operate respectively on the two opposite sides of the stock at the segment which has already passed through the die.

These chains normally consist of a series of links or tracks, connected together in various ways or else not connected together but merely positioned alongside each other. The chains are set in continuous rotation and, in cooperation with rigid guides, clamp the stock to be drawn and draw it in a straight line.

The perpendicular pressure exerted by the links on the drawn stock transmits the lengthwise motion of the chains to the stock and applies the necessary drawing action for the drawing of the stock.

The cooperation between the rigid guides and chains together with the lengthwise movement caused by the rotation of the chains produces by contact a perpendicular pressure of the links of the chains against the stock being drawn.

It should be borne in mind that this perpendicular pressure reaches and exceeds values about ten times greater than the value of the drawing action required for the drawing process in a lengthwise direction.

The reciprocal contact between the rigid guides and the chains leads to problems of wear due to the great sliding friction generated between the two flat surfaces, since a given contact takes place at least at the segment where the chains slide opposite to each other.

Various solutions to restrict these problems have been disclosed and, for the most part, provide for the use of rotary elements such as balls or rollers placed between the rigid guides and the chains so as to eliminate the sliding friction and replace it with a revolving friction of a much lower value.

U.S. Pat. No. 2,642,280 discloses a solution which, to reduce the friction, replaces the rigid guides with a series of rollers fitted in succession in the manner of a beam on ball bearings or bearings held on stationary supports.

These rollers are constantly stressed by considerable loads and have a limited life owing to the shear stresses and flexural stresses which they undergo owing to the loads acting on them.

Moreover, as the rollers are fitted so as to form a beam, the loads cause a central bending of the rollers and possible deformation of the lateral supports together with an incorrect contact between the chain and the rollers.

Furthermore, these rollers, precisely because they are positioned in a stationary position, undergo differentiated wear, with the outcome that the perpendicular pressure exerted on the drawn stock is not constant in the long term in a lengthwise direction.

U.S. Pat. No. 2,797,798 discloses an embodiment which entails substantially the same problems as those detailed above, even though the stationary lateral supports of the rollers are brought closer and therefore the bending moment generating the central bending is partly reduced.

In this embodiment, however, it is likely that the system will seize up during working owing to the smaller lateral play between the rollers and their respective stationary lateral supports.

U.S. Pat. No. 3,945,547 discloses an embodiment in which two rings of balls cooperate with the sides of the links of each single chain. These rings of balls circulate continuously, thus obviating differentiated wear of the balls, but in this way the lateral ends of the links are stressed by punctiform loads which, owing to the high pressures involved, deform and incise those lateral ends, thus no longer providing the required characteristics of the drawing action.

Moreover, as the two rings of balls are free to move independently of each other, the coordinated positioning of the balls on one side and the other side of the individual link is not ensured. This fact leads to imbalances of the pressure exerted on the link itself and therefore on the drawn stock.

According to a variant of this embodiment the rings of balls are replaced by rings of rollers connected to each other, In this case too the rollers cooperate with the lateral ends of the links, thus overcoming the problem of punctiform loads, but with this variant there still remains the problem of coordinating the movements of the two rings so as to ensure that the rollers acting on one side and the other of the links are always coaxial.

Besides, this variant entails the problem of increasing the overall bulk of the device owing to the overall lateral dimensions of the rollers. Moreover, in this case, seeing that the rollers take up more space than the balls, either the width of the central cantilever part of the link has to be reduced or the lateral supports of the link have to be enlarged.

With the first of these alternatives the maximum load which can be borne by the link is reduced or the specific load is increased, with the resulting occurrence of deflections, which cause the supports of the links to work only on the edges of the rollers and not on their whole surface, as required.

With the second alternative the overall bulk of the chain and of the whole traction unit is increased. In this case too it is necessary that the two rings of rollers should be always aligned to prevent misalignments.

JP-A-58-154412 discloses a traction unit for a drawing machine with three elements, namely a traction belt with an indented back that draws a metallic chain which presses on pressure rollers; each pressure roller is independent and is guided only in grooves positioned at the sides.

This disclosure cannot be applied to modern drawing machines, which require very short downtimes for maintenance work and high working speeds. In fact, this teaching does not permit loads misaligned in relation to the centre line nor uneven wear of the contact chain.

Moreover, this embodiment requires that there should be no constructional faults such as unevenness of the rollers, unlevel guides or an uneven thickness of the chains. In fact, if any of these shortcomings occur, the rollers become positioned crosswise and block the system.

This situation is possible owing to the necessary play incorporated in the grooves of the guides.

Moreover, as the motive load acts on the rubber teeth of the chain, these teeth are stressed with unbearable values.

SUMMARY OF THE INVENTION

The present applicants have designed, tested and embodied this invention to overcome the shortcomings of the state of the art and to achieve yet further advantages.

This invention tends to provide a system which can be fitted to modern fast drawing machines with a very small requirement of renewal and maintenance work.

Furthermore, the invention tends to embody a system which is very little sensitive to non-coaxial or misaligned loads, to uneven wear and to defects in construction, instalment and setting-up.

The unit for the lengthwise traction of drawn stock according to the invention comprises two opposed contrarotating drive chains consisting of links.

Each of these drive chains with links consists of a plurality of links and cooperates along its whole extent with a linked chain of movable idler rollers, which are positioned in the traction zone between a rigid guide and the links of the drive chain.

The linked chain of idler rollers is positioned within the drive chain with links and extends substantially along the whole length of that drive chain with links.

The drive chain with links is moved forwards in a coordinated manner by a suitable motor and, by sliding, draws with itself the linked chain of idler rollers.

The linked chains of idler rollers lie substantially on the same plane as their respective drive chains with drawing links and are set in rotation by the forward movement of their respective drive chains with drawing links. This has the effect that the speed of advance of the linked chains of idler rollers is about half the speed of advance of the respective drive chains with drawing links.

In the zone of traction the idler rollers of the linked chain of idler rollers are interposed between the respective drive chain with links and the rigid guide.

The rigid guide is positioned perpendicularly to the plane which contains substantially the axis of the drawn stock, just as the axis of the idler rollers and the plane of action of the drive links are also perpendicular to the plane containing substantially the axis of the drawn stock.

That plane of action coincides substantially with the centre line between the links of the two opposed, contrarotating drive chains with links.

By means of this lay-out the pressure needed to obtain the drawing action is discharged substantially at a right angle to the rigid guide and substantially on its centre line without intermediate deviations, this too even when there are misaligned loads or uneven wear or not perfectly accurate workmanship.

The idler rollers are engaged in a continuous rolling movement and therefore undergo substantially uniform wear, as also does the rigid guide; moreover, the idler rollers, being rotatably associated with the respective links of a linked chain of idler rollers, do not run the risk of becoming positioned crosswise.

Besides, the lateral links of the linked chain of idler rollers protrude from the idler rollers and cooperate with the edges of the rigid guides in maintaining their reciprocal lateral positioning.

Furthermore, the lateral links cooperate with the edges of an inner surface on the drive chain with links in maintaining their reciprocal lateral positioning.

Moreover, the lateral distance between the lateral links of the drive chain with links, in cooperation with lateral rigid guides, maintains the reciprocal lateral positioning of the drive chain with links in relation to the lateral rigid guides.

Besides, as the pressure discharged is normal and there is no risk of deflection, there is a correct distribution of the pressure over a broad zone without any critical points.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 2:
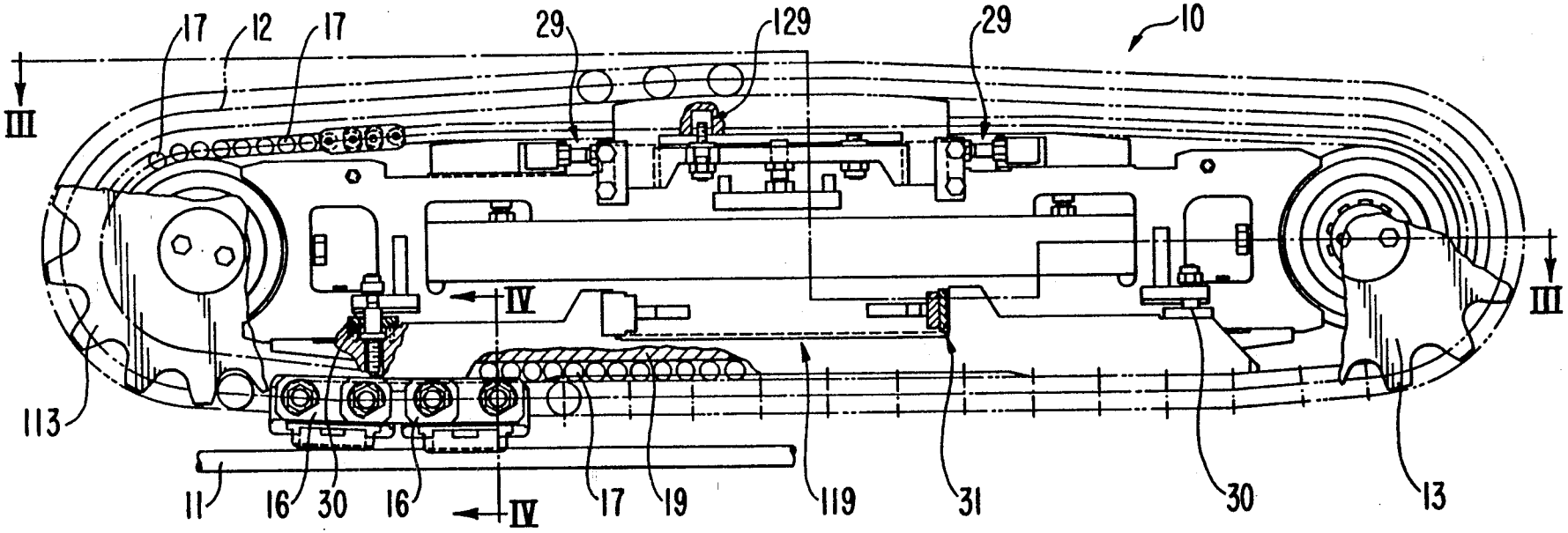
FIG. 2 is a partly cutaway side view of a traction unit for drawn stock according to the invention.
Figure 1:
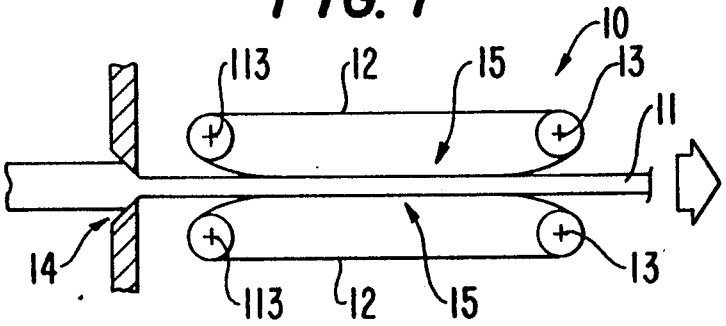
FIG. 1 is a diagrammatic side view of a drawing apparatus employing a traction unit according to the invention.
Figure 3:
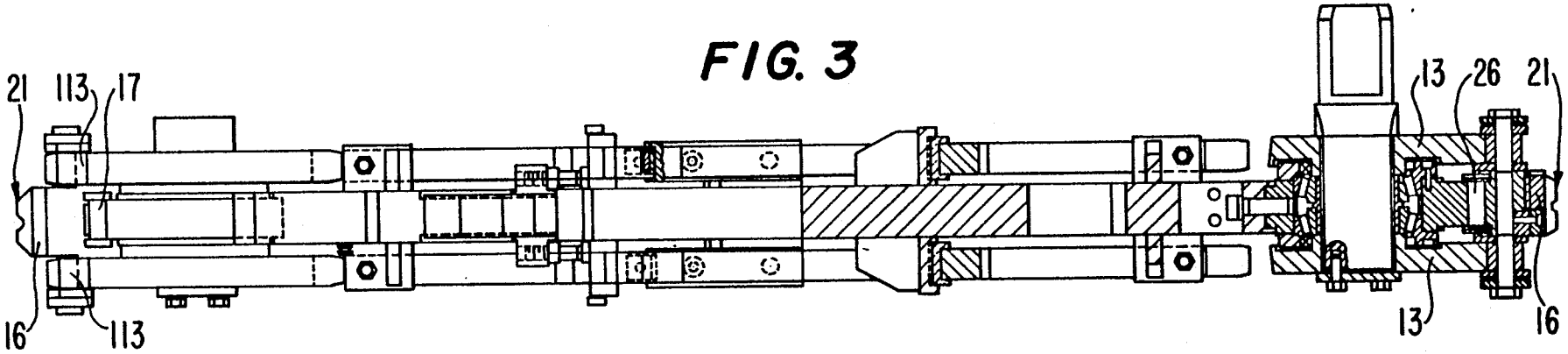
FIG. 3 is a partly cutaway view along the line III—III of the traction unit of FIG. 2.
Figure 4:
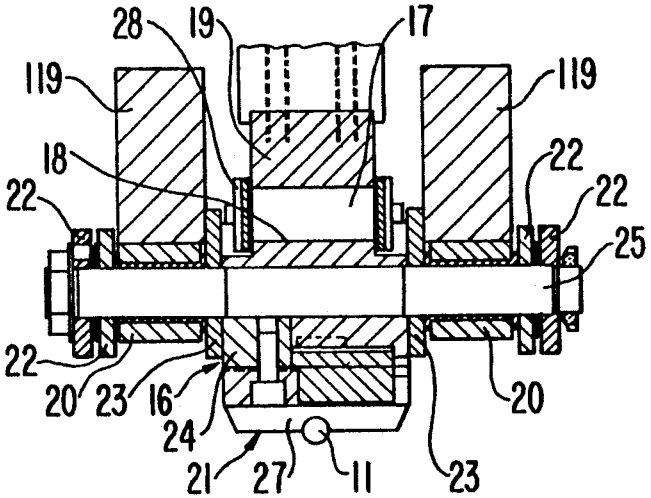
FIG. 4 shows in an enlarged scale a section along the line IV—IV of a detail of FIG. 2.

The reference number 10 in the figures indicates generally a traction unit according to the invention.

The traction unit 10 is installed advantageously downstream of a drawing die 14 of a known type so as to ensure the drawing of drawn stock 11 leaving the drawing die 14.

The traction unit 10 drawing the drawn stock 11 according to the invention comprises at least two contrarotating, opposed drive chains 12 with drawing links, which can move in a coordinated manner and lie substantially on the same plane as each other.

The invention can also be applied where there are three or more drive and drawing chains 12 arranged at 120° or 90° to each other or in another reciprocal geometric position.

Each drive chain 12 with drawing links consists of a plurality of links 16 connected to each other by lateral drawing links 22.

The following elements are included in the following order in each link between the lateral drawing links 22 positioned at one lateral end of the drive chain 12 and the lateral drawing links 22 positioned at the other lateral end of the same drive chain 12, namely a lateral idler roller 20, a possible retaining plate 23, a link body 24, another possible retaining plate 23 and a lateral idler roller 20, the whole assembly being supported on a pivot 25 which connects the lateral drawing links 22.

The diameter of the lateral idler rollers 20 is such that it is smaller than the height of the lateral drawing links 22.

The dimensions of the retaining plate 23 in the outward direction are substantially the same as those of the lateral drawing links 22, while the dimensions of the retaining plate 23 in the inward direction extend approximately so as to surpass the centre line of the idler rollers 17 of the linked chain 26 of idler rollers.

The link body 24 in the outward direction is associated in a replaceable manner with engagement and drawing sliders 27, which define the outer opposed surfaces 21 of the links 16.

The width of the link body 24 is slightly greater than the overall length of the links of the idler rollers 17. The link body 24 in the inward direction includes a sliding surface 18 the width of which is substantially analogous to that of the idler rollers 17 of the linked chain 26 of idler rollers.

The sliding surface 18 is therefore contained between the outer links 28 of the linked chain 26 of idler rollers, and these outer links 28 have a height greater than the diameter of the respective idler rollers 17.

The idler rollers 17 cooperate on one side with the sliding surface 18 and on the other side with a rigid guide 19, which too has a width substantially analogous to that of the idler rollers 17 of the linked chain 26 of idler rollers.

Each sliding surface 18 of each adjacent link, when it is in the segment where it cooperates directly with the idler rollers 17, creates together with the other sliding surfaces one single continuous surface which faces the rigid guide 19.

The two drive chains 12 with drawing links face each other and are parallel along a segment 15 along which the required pressure is applied to the drawn stock 11. The rigid guide 19 and lateral rigid guides 119 are included at least along this segment 15; the lateral rigid guides 119 have a width substantially the same as the width of drive sprockets 13 and driven sprockets 113 and substantially equal to the length of the lateral idler rollers 20.

The outer surface 21 of the links 16 of the drive chains 12 with drawing links has a shape coordinated with the profile of the drawn stock 11 and cooperates with the drawn stock 11 along the whole segment 15 in which the drive chains 12 with drawing links face each other and are kept thrust together.

Each of the drive chains 12 with drawing links is driven forward by one pair of parallel and coaxial drive sprockets 13, which are actuated in coordination by a motor (not shown here) and act on the lateral idler rollers 20. Parallel and coaxial driven sprockets 113 are included, as also are means 29-129 of a known type to tension the drive chains 12 with drawing links.

Levelling means 30, the rigid guide 19 and the possible lateral rigid guides 119 may also be included together with guides 31 for the sliding.

The linked chain 26 of idler rollers 17 is moved by the drawing action of the links 16 and lies on a plane corresponding substantially to the plane containing the axis of drawing of the drawn stock 11.

The plane containing the drawing axis of the drawn stock 11 corresponds substantially also with the plane of the respective drive chain 12 with drawing links and cooperates with the centre line of the perpendicular planes defined by the links 16, idler rollers 17 and rigid guide 19 respectively.

The drawing pressure is generated by the contact of each drive chain 12 including drawing links, which discharges that pressure directly on the linked chain 26 of idler rollers 17 and onto the respective rigid guide 19.

The transverse position of the idler rollers 17 is substantially in the centre of the links 16 of the drive chains 12, while the length of the idler rollers 17 cooperates with a great part of the width of those links 16.

By means of the traction unit 10 according to the invention the links 16 are prevented from being subjected to bending moments, since the load due to the pressure exerted on the drawn stock 11 and the resulting reaction act substantially on the same link portions 16.

Moreover, in view of the greater contact surface between the idler rollers 17 and the links 16 the great loads required for the drawing action are distributed more evenly, thus reducing the wear and deformation of the links 16 and idler rollers 17.

The linked chain 26 of idler rollers 17 can run owing to the drawing action applied by the links 16 and advances substantially at a speed about half of that of the relative drive and drawing chain 12.

The ring of the linked chain 26 of idler rollers 17, as shown in FIG. 2, may surround the drive sprockets 13 and driven sprockets 113 or may surround only one or some of the drive and driven sprockets 13-113.

The lateral separated positioning of the lateral idler rollers 20 makes possible a better alignment and a more uniform transmission of motion.

I claim:

1. Traction unit for a drawing machine, the unit cooperating with a drawing die and comprising at least two drive chains with drawing links lying on the same plane, each of said at least two drive chains comprising a plurality of links having an opposed inner surface and outer drawing surface and opposed lateral outer sides, each of said at least two drive chains cooperating with load bearing rollers and with a rigid guide, the drawing action being obtained by the forward movement of the drive chains with drawing links and by the reciprocal contact taking place between the drawing chains with drawing links in their opposed drawing segment, the unit being characterized in that the load bearing rollers comprise a linked chain of idler rollers positioned in a ring, the linked chain of idler rollers being able to be moved by sliding and being placed between the inner surface of the links and the rigid guide, in which each link has at each of its two lateral outer sides a lateral drawing and, on the inner side of the lateral drawing links, lateral idler rollers link, said link further comprising a link body cooperating with a connecting and positioning pivot and being included in an intermediate position between the lateral drawing links, and further comprising lateral idler rollers, each of which is provided between said link body and each of said lateral drawing links.

2. Traction unit as in claim 1, in which said idler rollers are linked in said linked chain by outer links, wherein a height of said outer links of the idler rollers is greater than a diameter of the idler rollers.

3. Traction unit as in claim 1, in which the height of the lateral drawing links is greater than the diameter of the lateral idler rollers.

4. Traction unit as in claim 1, in which the link body comprises within itself and on its center line a sliding surface having a width substantially equal to the length of an idler roller, each sliding surface forming together with the sliding surfaces of the adjacent links one single sliding surface opposite to the sliding surface of the rigid guide.

5. Traction unit as in claim 1, in which retaining plates are included between the lateral idler rollers and the link body.

6. Traction unit as in claim 5, in which an inward height of the retaining plates reaches the vicinity of a center link of the idler rollers, while a width of the link body is greater than an overall length of the links of the idler rollers.

7. Traction unit as in claim 1, further comprising lateral rigid guides having a width substantially the same as the length of the lateral idler rollers cooperating with the lateral idler rollers.

8. Traction unit as in claim 1, in which at least the rigid guide includes levelling means for levelling each of said at least two drive chains and sliding guides.

* * * * *